United States Patent [19]

Reinehr et al.

[11] 4,087,494

[45] May 2, 1978

[54] PROCESS FOR THE PRODUCTION OF DYED ACRYLIC FIBRES

[75] Inventors: Ulrich Reinehr, Dormagen; Hans-Dieter Braun, Wuppertal; Robert Dippelhofer, Dormagen, all of Germany

[73] Assignee: Bayer Aktiengesellschaft, Leverkusen, Germany

[21] Appl. No.: 639,821

[22] Filed: Dec. 11, 1975

[30] Foreign Application Priority Data

Dec. 14, 1974 Germany ..... 2459212

[51] Int. Cl.[2] ..... D01F 1/04

[52] U.S. Cl. ..... 264/78; 8/17; 8/31; 8/177 R; 260/42.19; 264/182; 264/206; 264/211

[58] Field of Search ..... 260/42.19; 8/31, 177 R, 8/17; 264/78, 211, 182, 206

[56] References Cited

U.S. PATENT DOCUMENTS

| | | | |
|---|---|---|---|
| Re. 23,722 | 10/1953 | Pike | 106/176 |
| 1,975,153 | 10/1934 | Jacquet | 264/171 |
| 3,468,841 | 9/1969 | Corbiere et al. | 264/182 |
| 3,969,559 | 7/1976 | Boe | 428/87 |
| 3,975,482 | 8/1976 | Rulison | 264/182 |

FOREIGN PATENT DOCUMENTS

| | | | |
|---|---|---|---|
| 1,669,375 | 12/1971 | Germany | 264/211 |

*Primary Examiner*—Jay H. Woo

*Attorney, Agent, or Firm*—Plumley and Tyner

[57] ABSTRACT

This invention relates to a process for the production of dyed filaments or fibres of acrylonitrile polymers, wherein carbon black pigments are added to the polymer before the spinning process and the filament containing carbon black pigments are dyed. By this process it is possible to save considerable amounts of dye-stuff.

2 Claims, No Drawings

PROCESS FOR THE PRODUCTION OF DYED ACRYLIC FIBRES

This invention relates to a process for the production of batch-dyed or continuously dyed wet-spun or dry-spun acrylic fibres or filaments which can be dyed light and dark shades and which have already been pigmented with carbon black.

It is already known from DT-OS 1,669,375 that carbon black pigements can be spun into polyacrylonitrile in order to obtain shades ranging from grey to black.

It has now been found that acrylic fibres or filaments pigmented with carbon black can be overdyed with aqueous dye solutions in any light and dark shades with a gray component.

Accordingly it is an object of this invention to provide a process for the production of dyed acrylic fibres and filaments.

It is further object to provide a process for the production of dyed acrylic fibres and filament, by which it is possible to save considerable amounts of dye compared with conventional dyeing-processes.

Other objects will be evident from the description and the examples.

These objects are accomplished by a process for the production of a dyed filament of fibre of an acrylonitrile polymer, wherein a carbon black pigment is added to the polymers before the actual spinning process and the filament or fibre containing said carbon black pigment is dyed after spinning.

The carbon black pigment is preferably added in a quantity of from 0.001 to 3% by weight, based on the polymer.

The carbon black pigment is preferably added to the spinning solution. It is best to add the carbon black pigment to the acrylonitrile polymer solution and to obtain uniform distribution by stirring, followed by filtration and spinning.

The process according to the invention for overdyeing acrylic fibres spun with carbon black pigments from an aqueous dye bath is, of course, limited to shades with a grey components. Thus, it is not possible, for example, to produce any light yellow, red or green shades, but extremely good tints with the exception of brilliant shades. It is possible by correspondingly dosing the carbon black during spinning and controlling the addition of dyes in the dye baths, to obtain a wide range of colours ranging from light shades of all kinds to dark shades.

Overdyeing of the fibres pigmented with carbon black in aqueous solution may be carried out either continuously during fibre production or in batches on the finished acrylic tow.

The process according to the invention includes both dry spinning and also wet spinning.

Continuous dyeing may be carried out, for example, with any wet-spun acrylic fibres because they take up dyes particularly readily in the aquagel form. Dry-spun acrylic fibres are particularly suitable for continuous dyeing during production in cases where they contain at least 150 milliequivalents of acid groups per kg of polymer. A dyeing process of the kind described in DT-OS 2,317,132 is particularly suitable for dyeing dry-spun fibres or filaments.

Conventionally dry-spun or wet-spun acrylic fibres into which carbon black pigments have been spun, which have been aftertreated and which generally contain from 60 to 100 milliequivalents of acid groups per kg of polymer, may be dyed, for example, semi-continuously by the "Vanysol process" (Literature: Textilveredlung 4 (1969), No. 8, pages 646 - 647; cf. Examples 10 B and 11) or by the pad-steam process, for example the "Serracant process" (Literature: Melliand Textilberichte 5/1972, pages 549 - 554, J. Cegarra J. Soc. Dyers Colorists 86 (1970), pages 26 - 29; cf. Example 12) using aqueous dye solutions. The major disadvantage of these processes in relation to continuous dyeing during fibre production is that prolonged steaming times are required to fix the dyes.

The dyeing temperatures may be varied over a wide range from 20° C to boiling temperature. The residence times in the dye baths or troughs vary from a few seconds, for example in the case of wet-spun acrylic fibres in gel form, to at most one minute. Dyeing may be carried out with any water-soluble azo mordant or triphenyl methane dyes which enter into a dye bond with the acid groups of the acrylonitrile copolymers (for example sulphonate groups).

The invention affords the significant advantage that, depending upon the carbon black content of the spun material, more than 90% of the dye content of the pure dyes used is replaced for the same depth of colour in comparison with fibres into which no carbon black pigments have been spun. The advantage of the present invention is particularly apparent in the case of deep shades, for example "dark brown", because, in this case, a very considerable quantity of dye can be saved by the use of a high proportion of carbon black in the fibres.

In addition, other surprising advantages are obtained. For example, improved wet fastness values, such as fastness to washing, perspiration and rubbing, are obtained, as shown in the Examples. In addition, the "bleeding" of dyes which acrylic fibres that have been dyed deep shades often show in the course of further processing, for example in the course of a fabrication process, for example during steaming and washing, is suppressed or completely avoided.

In the context of the invention, acrylonitrile polymers are polymers which consist of at least 85% by weight of acrylonitrile. In addition, up to 15% by weight of copolymerised ethylenically unsaturated monomers may be present. Examples of such monomers are vinyl esters, for example vinyl acetate, and/or acrylic acid or methacrylic acid esters such as, for example methyl(meth)acrylate or ethyl(meth)acrylate.

Polymers which contain comonomers with acid groups are of course particularly suitable. Comonomers of this kind are, in particular, compounds containing carboxylic acid, sulphonic acid or sulphonimide groups, such as for example allyl sulphonic acid, vinyl sulphonic acid, styrene sulphonic acid, methyallyl sulphonic acid, methacryl amino-benzene-benzene disulphonimide or their salts, preferably their alkali metal salts.

In principle, the carbon black pigment used may be any pigment which does not have any adverse effects either upon the various process stages or upon the material to be treated.

One particularly preferred carbon black is a carbon black with a relatively small particle diameter, because the particle size influences both the blackness and covering power of the fibre material to the extent that both parameters increase in intensity with decreasing particle diameter. One example of a carbon black of this type is a pigment in low-dust bead form of the kind manufactured by Columbian Carbon International under the name "Ravenschwarz 30" which has an average particle diameter of 27 mμ, a pH-value of 7, an apparent density of 528 g/l and which consists of 99% of bonded carbon (method of manufacture: furnace black of specific gravity 1.80 g/cc).

The process according to the invention may be carried out, for example, as follows:

The required quantity of carbon black pigment is worked into the spinning solution in the manner already described (in principle, the carbon black may also be mixed with a polymer powder and then dissolved) and the solution is spun into filaments by a conventional dry-spinning or wet-spinning process. Most of the solvent is then removed from the filaments which are then dyed in the usual way in a dye bath at temperatures of up to 100° C, fixed, stretched in a ratio of 1:2.5 to 1:6 (stretching may also be carried out during drying) and after-treated in known manner. In the case of a batch process, stretching may even be carried out completely or in part before dyeing.

A few preferred embodiments of the invention are described in the following Examples, which are to further illustrate the invention without limiting it and in which the percentages are by weight unless otherwise stated.

EXAMPLE 1

An acrylonitrile copolymer of 91.1% of acrylonitrile; 5.5% of methyl acrylate and 3.4% of sodium methallyl sulphonate was dissolved in dimethyl formamide, followed by the addition with stirring of a 10% by weight solution of "Ravenschwarz 30" in DMF in such a quantity that the addition of carbon black pigment made up 0.01% by weight, based on the solids content of the polymer. The filtered spinning solution, which had a final concentration of approximately 29% by weight, was spun by the dry-spinning process. The spun filaments are subsequently further processed into a tow with a total denier of 960,000. The tow is first passed through a tank filled with water at room temperature for conditioning and removing the solvent. The tank is provided with a pair of pressure rollers at its inlet and outlet ends. The moist, parallelised tow which is approximately 150 mm wide and has a moisture content of 65% is then squeezed out through a pair of pressure rollers (to give a residual moisture content of 40 - 42%) and passed under tension through a dryer. Depending upon the rate of travel of the tow, the temperature of the dryer is regulated in such a way that the tow leaves the dryer with a residual moisture content of approximately 5%. For example, the temperature of the dryer is adjusted to 110° C for a rate of travel of the tow of 7 meters per minute and a drying capacity equivalent to 16 meters of tow with an overall denier of 960,000 dtex. The unstretched tow is then dyed at room temperature in a dye trough with a dye mixture of 0.1 g/l of a dye of formula A, 0.15 g/l of a dye of formula B and 1.1 g/l of a dye of formula C, in order to obtain a silver-grey dye finish. The residence time in the dye trough is about 3 to 4 seconds. The uptake of the dye solution amounts to 120%. The dyed tow is then fixed under saturated steam conditions at 102° to 103° C in a festoon-type steamer. The residence time in the steamer amounts to approximately 2 minutes for a rate of travel of the tow of 7 meters per minute. The fixed, dyed tow is then stretched in a ratio of 1:3.6 in boiling water, washed and brightened. The dyed tow, which shows a shrinkage of 23 to 24% after stretching, is then subjected to a dry shrinkage treatment in a drying unit comprising 14 perforated drums. Shrinkage is carried out in stages of about 15% and about 5%, so that the tow leaves the drying unit with approximately 3 to 4% residual boiling-induced shrinkage. The rate of travel of the tow is approximately 25 meters per minute and the residence time approximately 2 minutes. The temperature at the input end of the drying unit is between 130° and 140° C and, at its output end, between 60° and 70° C. The tow dyed silver-grey is subsequently crimped and deposited in cartons. Fibre yarns with a denier of 3.3 dtex produced from the dyed tow show thoroughly dyed dumbell forms in the fibre cross-section without any peripheral dyeing. Milliequivalents of acid groups/kg of polymer = 198. Fastness to light = 6 - 7; fastness to washing and perspiration = 5; fastness to rubbing in dry and wet form = 5; fastness to overdyeing: bleeding against polyacrylonitrile, neutral and in acetic acid = 5.

1. Determination of fastness values:

Literature: "Farbechtheitsnormen" Taschenbuch 16 of the Deutscher Normenausschuss, Beuth Vertrieb GmbH, Berlin 30 (1966):

a. fastness to light determined in accordance with DIN 54 004, pages 68 - 72
b. fastness to washing at 40° C determined in accordance with DIN 54 014, pages 88 - 89
c. fastness to perspiration determined in accordance with DIN 54 020, pages 96 - 97
b. fastness to rubbing (dry and wet) determined in accordance with DIN 54 021, page 98
e. fastness to overdyeing determined in accordance with DIN 54 049, pages 139–140

2. Determination of dye absorption:

100 g of dry polyacrylonitrile tow with an individual denier of 3.3 dtex and a tow weight of approximately 27 g/m are padded with the dye mixture (for types and concentrations of the dyes used, see Example 1) through squeezing rollers, and subsequently weighed. After padding, the material of Example 1 weighs 220 g, in other words the dye absorption amounts to 120%.

3. Determining the acid groups in the acrylonitrile copolymer:

In order to remove salts, the acrylonitrile copolymer to be tested is thoroughly boiled for 30 minutes with distilled water and then dried at 50° C in a vacuum drying cabinet. 500 mg of the polymer are dissolved under heat in 25 ml of dimethyl sulphoxide and the dissolved sample is passed twice through an exchange tube (tube diameter 12 mm, tube length approximately 200 mm) containing Lewatit S 100 ( a cation exchanger manufactured by the Merck Company). This is followed by washing with 75 ml of DMSO. 10 drops of phenolphthalein are added to the eluate, followed by titration with 0.05 normal alcoholic potassium hydroxide until the colour changes to pink. The blank value of a pure DMSO solution is similarly determined and subtracted from the titration value.

4. Dyes used:

Dye A

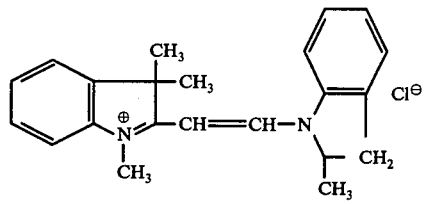

-continued

Dye B

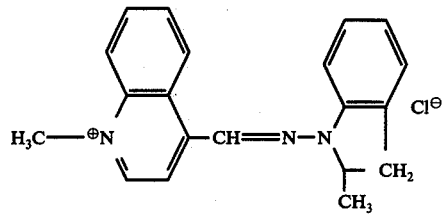

Dye C

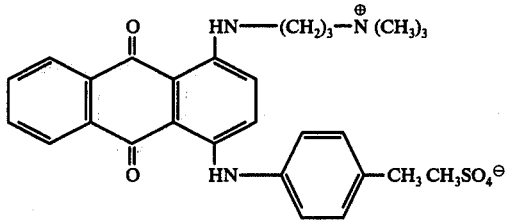

EXAMPLE 2 (Comparison)

A tow of an acrylonitrile polymer with the same composition as described in Example 1 was produced in the same way, except that no carbon black was spun in. The tow was prewashed, squeezed out and predried at 100° C. The spun material had a residual moisture content of approximately 6%. It is then dyed at room temperature in a dip trough with a dye mixture of 0.44 g/l of a dye corresponding to formula A, 0.55 g/l of a dye corresponding to formula B and 2.6 g/l of a dye corresponding to formula C (for dye formulae, see Example 1) in order to obtain the same silver-grey colour as in Example 1. All the other after-treatment conditions remain unchanged. Fibre yarnns with a denier of 3.3 dtex produced from the tow dyed silver-grey show thoroughly dyed dumbell forms in the fibre cross-section. The strength of colour of the two silver-grey dyed tows of Examples 1 and 2 is compared by visual evaluation in daylight. The two tows are equivalent to one another in terms of strength of colour, as visually assessed. Fastnesses: fastness to light = 6 - 7; fastness to washing and perspiration = 5; fastness to rubbing (dry) = 4 - 5; (wet) = 4. Fastness to overdyeing: bleeding against polyacrylonitrile neutral = 4; in acetic acid 3 - 4.

Both dye recipes for producing the tows with the same silver grey colour with and without carbon black are compared in the following Table. Column 4 shows the percentage saving of dye per individual dye, whilst column 5 shows the average total saving of dye in the dyed tow which contains carbon black pigments.

The percentage saving of dye per individual dye is calculated as follows:

$$100 - \left[\frac{\text{dye concentration (g/l) of fibre with carbon black} \times 100}{\text{dye concentration (g/l) of fibre without carbon black}}\right]$$

The average total saving of dye is calculated as follows:

$$= \frac{\text{percentage saving of dye A + B + C}}{3}$$

| Dye | Dye concentration (g/l): Example 1 fibre containing carbon black | Dye concentration (g/l): Example 2 fibre without cargon black | Percentage saving of dye: individual | Percentage saving of dye: total |
|---|---|---|---|---|
| A | 0.10 | 0.44 | 77 | |
| B | 0.15 | 0.55 | 73 | 73 |

-continued $$100 - \left[\frac{\text{dye concentration (g/l) of fibre with carbon black} \times 100}{\text{dye concentration (g/l) of fibre without carbon black}}\right]$$

The average total saving of dye is calculated as follows:

$$= \frac{\text{percentage saving of dye A + B + C}}{3}$$

| Dye | Dye concentration (g/l): Example 1 fibre containing carbon black | Dye concentration (g/l): Example 2 fibre without cargon black | Percentage saving of dye: individual | Percentage saving of dye: total |
|---|---|---|---|---|
| C | 1.10 | 2.60 | 68 | |

As can be seen from the Table, it is possible, by spinning carbon black pigments into acrylonitrile tows, to save more than 70% of the quantity of dye required to obtain the same silver-grey colour, so that dyeing can be carried out particularly favourably from the point of view of cost.

EXAMPLE 3

An acrylonitrile copolymer with the same composition as in Example 1, except that it contains 0.3% by weight of carbon black pigments, based on the solids content of the polymer, was dry-spun and pretreated in the same way as in Example 1. Dyeing was carried out at room temperature in a dye trough filled with a dye mixture of 7.6 g/l of a dye corresponding to formula D, 7.0 g/l of a dye corresponding to formula G and 10 g/l of a dye corresponding to formula E (for dye formulae, see Example 4), in order to obtain a dark-brown colour. The residence time was 3–4 seconds. The subsequent aftertreatment was carried out in the same way as in Example 1.

Fibre yarns with a denier of 3.3 dtex were produced from the dyed tow. Fibre cross-section: thoroughly dyed dumbells. Fastness to light = 6–7; fastness to washing and perspiration = 5; fastness to rubbing (dry and wet) = 5; fastness to overdyeing: bleeding against polyacrylonitrile, neutral and in acetic acid = 2–3.

EXAMPLE 4 (comparison)

An acrylonitrile polymer with the same composition as in Example 1, except that it did not contain any carbon black pigments, was dry-spun and pretreated in the same way as in Example 1. Dyeing was carried out with a dye mixture of 12 g/l of a dye corresponding to formula D, 11 g/l of a dye corresponding to formula G and 20 g/l of a dye corresponding to formula E, in order to obtain the same dark brown colour as in Example 3. The strength of colour was again visually compared. Fibre cross-section: thoroughly dyed dumbells. Fastnesses: fastness to light = 6–7; fastness to washing and perspiration = 5; fastness to rubbing (dry) = 5; fastness to rubbing (wet) = 4–5; fastness to overdyeing: bleeding against polyacrylonitrile, neutral = 2; in acetic acid = 1–2.

Both dye recipes for producing dark brown tows with the same strength of colour, with and without carbon black, are again compared in the following Table.

| Dye | Dye concentration g/l: Example 3 Fibre with carbon black | Example 4 Fibre without carbon black | Percentage saving of dye: individual | total |
|---|---|---|---|---|
| D | 7.6 | 12.0 | 36 | |
| G | 7.0 | 11.0 | 36 | 47 |
| E | 10.0 | 20.0 | 50 | |

As can be seen from this comparison, it is possible, by spinning 0.3% by weight of carbon black pigments into the acrylic tow, to save approximately 47% of the quantity of dye which would be necessary to produce a tow, with the same depth of colour, which does not have any carbon black spun into it.

Dye D

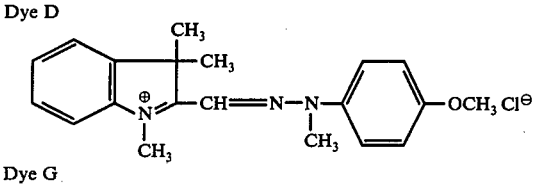

Dye G

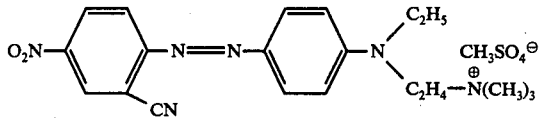

Dye E

A mixture of 75 parts of dye $e_1$ and 25 parts of dye $e_2$

Dye $e_1$

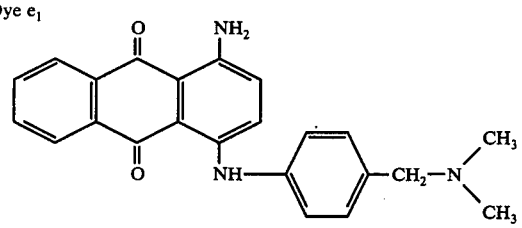

Dye $e_2$

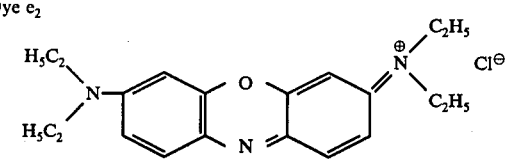

EXAMPLE 5

An acrylonitrile copolymer of 91.5% of acrylonitrile, 5.5% of methyl acrylate and 3% of sodium methallyl sulphonate was dissolved in dimethyl formamide, followed by the addition with stirring of a 10% by weight solution of "Ravenschwarz 30" in DMF in such a quantity that the addition of carbon black pigment makes up 0.01% by weight, based on the solids content of the polymer. The filtered spinning solution, which has a final concentration of approximately 29%, was dry-spun and doubled into a tow with a total denier of approximately 962,000 dtex, in the same way as described in Example 1. The tow is then pretreated in the same way as described in Example 1 and the unstretched tow is dyed at room temperature in a dye trough filled with a dye mixture of 0.32 g/l of a dye corresponding to formula A, 0.2 g/l of a dye corresponding to formula B and 0.28 g/l of a dye corresponding to formula C (for dye formulae, cf. Example 1). Residence time in the dye trough: 3–4 seconds, dye absorption 120%. The two dyed a "beige" colour is then aftertreated in the same way as in Example 1. Fibre cross-section: thoroughly dyed dumbells. Fastness to light = 6–7; fastness to washing and perspiration = 5; fastness to rubbing (dry and wet) = 5; milliequivalents of acid groups per kg of polymer 32 158.

EXAMPLE 6 (Comparison)

A tow of an acrylonitrile polymer with the same chemical composition as in Example 5 was produced by dry-spinning and pretreated in the same way as in Example 5, except that no carbon black was spun in. The tow was then dyed at room temperature in a dye trough containing a dye mixture of 0.5 g/l of a dye corresponding to formula A, 0.46 g/l of a dye corresponding to formula B and 0.8 g/l of a dye corresponding to formula C, in order to obtain the same beige colour as in Example 5. All the other aftertreatment conditions remain unchanged. Fibre cross-section: thoroughly dyed dumbells. Fastnesses: fastness to light 6–7; fastness to washing = 5; fastness to perspiration 4–5; fastness to rubbing (dry) = 4–5; fastness to rubbing (wet) = 4.

Both dye recipes for producing the beige-coloured tows with the same strength of colour, with and without carbon black, are again compared in the following Table.

| Dye | Dye concentration (g/l): Example 5 fibre with carbon black | Example 6 fibre without carbon black | Percentage saving of dye: individual | total |
|---|---|---|---|---|
| A | 0.32 | 0.50 | 36 | |
| B | 0.20 | 0.46 | 56 | 52 |
| C | 0.28 | 0.80 | 65 | |

By comparison with spinning in the absence of carbon black, it is possible to save approximately 52% of the quantity of dye required to obtain the same beige-colour when a tow containing 0.01% by weight of carbon black pigments (Example 5) is used.

EXAMPLE 7

An acrylonitrile copolymer of 93.6% of acrylonitrile, 5.7% of methyl acrylate and 0.7% of sodium methallyl sulphonate was dissolved in DMF, followed by the addition with stirring of a 10% by weight solution of "Ravenschwarz 30" in DMF in such a quantity that the addition of carbon black pigment makes up 0.01% by weight, based on the solids content of the polymer. The filtered spinning solution, which had a final concentration of 24%, was spun into a spinning bath consisting of 50% of DMF and 50% of water. The temperature of the precipitation bath was 7° C and the take-off rate was 10 meters per minute. The tow with a total denier of 1,062,000 dtex was passed through a tank filled with water at room temperature in order to remove solvent. The tank is provided with a pair of pressure rollers at its inlet and outlet ends. The moist, parallelised tow, which has a width of approximately 150 to 160 mm, is then squeezed between a pair of pressure rollers and passed under tension through a dryer. The temperature of the dryer is regulated, according to the rate of travel of the tow, in such a way that the tow leaves the dryer with a residual moisture content of approximately 5% by weight. For example, a residual moisture content of 5.9%, of which 3.6% is residual solvent (DMF), is obtained for a rate of travel of the tow of 10 meters per minute, a dryer capacity of 16 meters of tow with the above-mentioned overall denier and a maximum dryer temperature of 130° C. The tow is then dyed at room temperature in a dye trough containing a dye mixture of 0.1 g/l of a dye corresponding to formula A, 0.15 g/l of a dye corresponding to formula B and 1.1 g/l of a dye corresponding to formula C, in order to obtain a silver-grey colour (for dye formulae, see Example 1). The residence time in the dye trough is approximately 3 to 4 seconds. The dye absorption is 160%. The dyed tow is then fixed under saturated steam conditions at 103° to 105° C in a festoon-type steamer. The residence time in the steamer is approximately 2 minutes. The fixed, dyed tow is then stretched 1:5.0 in boiling water, washed, brightened and dried in a dryer at 130° C with a permitted shrinkage level of 20%, subsequently crimped and cut to staple. Fibre yarns with a denier of 3.1 dtex produced from the silver-grey tow show thoroughly dyed circular to oval cross-sectional forms in the fibre cross-section. Milliequivalents of acid groups per kg of polymer = 80; fastness to light = 6; fastness to washing and perspiration = 5; fastness to rubbing (dry) = 5; fastness to rubbing (wet) = 4–5; fastness to overdyeing: bleeding against polyacrylonitrile, neutral and in acetic acid = 5.

EXAMPLE 8 (Comparison)

An acrylonitrile copolymer with the same chemical composition as in Example 7 was wet-spun, but without the addition of carbon black pigments to the spinning solution, pretreated and subsequently dyed in the same way as in Example 7. In order to obtain a silver-grey colour similar to that obtained in Example 7, the tow had to be dyed at room temperature with a dye mixture of 0.44 g/l of a dye corresponding to formula A, 0.55 g/l of a dye corresponding to formula B and 2.6 g/l of a dye corresponding to formula C. All the other after-treatment conditions remain unchanged. Fibre cross-section: thoroughly dyed circular to oval cross-sectional forms. Fastness to light = 6–7; fastness to washing and perspiration = 4–5; fastness to rubbing (dry) = 5; fastness to rubbing (wet) = 4; fastness to overdyeing: bleeding against polyacrylonitrile, neutral and in acetic acid = 4. As can again be seen from the concentration figures for the dyes in comparison with Example 7, an approximately 73% saving of dye can be obtained by spinning in the presence of carbon black (cf. Table Example 2).

EXAMPLE 9

An acrylonitrile copolymer with the same chemical composition as in Example 7 was wet-spun in the same way as in Example 7 following the addition of 0.01% by weight of carbon black pigments, based on the solids content of the polymer, to the spinning solution, and was subsequently prewashed with water at boiling temperature in three successive tanks, stretched 1:5.0 and, without drying, was dyed at 70° C in a dye bath with the same dye mixture and dye concentrations as in Example 7. The residence time in the dye bath is approximately 3 seconds. The dyes on the silver-grey tow are subsequently fixed under tension in a festoon dryer at a maximum drying temperature of 130° C. The residence time is approximately 1.5 minutes. The tow is then washed, brightened, dried at a maximum temperature of 150° C with a permitted shrinkage level of 20%, crimped and deposited in the form of an endless tow. The silver-grey tow is identical in colour and dye finish with the tow of Example 7.

EXAMPLE 10

A) An acrylonitrile copolymer of 93.6% of acrylonitrile, 5.7% of methyl acrylate and 0.7% of sodium methallyl sulphonate was dissolved in DMF, followed by the addition with stirring of a 10% by weight solution of "Ravenschwarz 30" in DMF in such a quantity that the addition of carbon black pigment amounts to 0.3% by weight, based on the solids content of the polymer. The filtered spinning solution with a total concentration of approximately 29% by weight was dry spun and doubled into a tow with an overall denier of 960,000 dtex, in the same way as described in Example 1. The tow is then prewashed, squeezed out and dried in the same way as in Example 1. The unstretched tow is dyed at room temperature in a dye trough containing a dye mixture of 0.1 g/l of a dye corresponding to formula D, 2.0 g/l of a dye corresponding to formula F and 5.0 g/l of a dye corresponding to formula H, in order to obtain a marine-blue colour. The dye absorption is 100%. The subsequent aftertreatment is carried out in the same way as in Example 1. A streaky, partly undyed tow is obtained. Fibre cross-section: peripheral dyeing. Milliequivalents of acid groups per kg of polymer = 80.

Dye formula F

Mixture of 69.5 parts of dye corresponding to formula $f_1$: 16.9 parts of parafuchsine; 6.8 parts of dye corresponding to $f_2$; 1.9 parts of dextrin; and 4.8 parts of sodium sulphate.

Dye formula $f_1$:

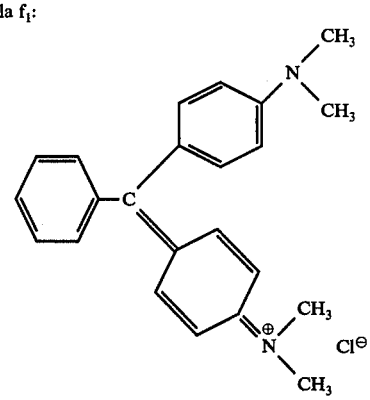

Dye formula $f_2$:

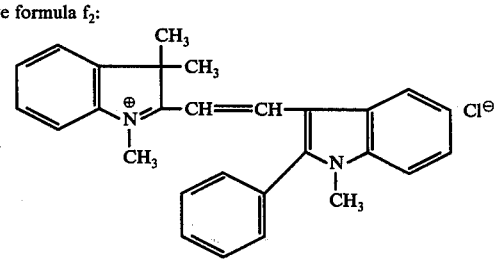

Dye formula H:

-continued

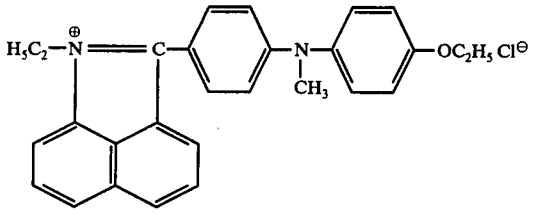

B. If, after dyeing in the dye trough, the tow pigmented with carbon black is placed in perforated cans and batch-steamed for 20 minutes at 102° C in a steaming cabinet and then stretched in a ratio of 1:3.6 in boiling water, washed, brightened and further treated in the same way as in Example 1, a uniformly dyed, marine-blue tow is obtained. Fibre cross-section: thoroughly dyed dumbells.

EXAMPLE 11 (Comparison)

An acrylonitrile copolymer with the same composition as in Example 10 was dry spun in the absence of carbon black and doubled into a tow with an overall denier of 960,000 dtex. The tow was then prewashed, squeezed out and dried in the same way as in Example 1. The unstretched tow was dyed at room temperature in a dye trough. In order to obtain optically the same marine-blue colour as in Example 10, dyeing was carried out at room temperature with a dye mixture of 0.4 g/l of a dye corresponding to formula D, 8.0 g/l of a dye corresponding to formula F and 15.0 g/l of a dye corresponding to formula H (for dye formulae, see Example 10). The dye absorption is 100%. The tow was then placed in perforated cans and batch-steamed for 20 minutes at 102° C in a steaming cabinet, and subsequently stretched in a ratio of 1:3.6 in boiling water, washed brightened and further treated in the same way as in Example 1. A marine-blue tow dyed level throughout with an individual denier of 3.3 dtex is obtained. Fibre cross-section: thoroughly dyed dumbells.

Both dye recipes for producing the marine-blue tows with and without carbon black are compared with one another in the following Table:

| | Dye concentration (g/l | | | |
|---|---|---|---|---|
| | Example 10 fibre with carbon | Example 11 fibre without carbon | Percentage saving of dye | |
| Dye | black | black | Individual | Total |
| D | 0.10 | 0.40 | 75 | |
| F | 1.0 | 8.0 | 87 | 76 |
| H | 5.0 | 15.0 | 66 | |

Accordingly, by comparison with spinning in the absence of carbon black, it is possible to obtain an average saving of 72% of dye where a tow pigmented with 0.3% by weight of carbon black is used.

EXAMPLE 12

An acrylonitrile copolymer with the same chemical composition as in Example 10 was again dry spun with 0.1% by weight of carbon black pigments, based on the solids content of the polymer, and doubled into a tow with a total denier of 960,000 dtex. The tow is stretched to 3.6 times its original length in boiling water, subsequently washed, brightened and dried in a dryer at a maximum temperature of 150° C with a permitted shrinkage level of 20%. The tow is then crimped and deposited in the form of an endless tow. The final individual fibre denier amounts to 3.3 dtex. The tow pigmented with carbon black is then dyed at room temperature in a dye trough containing a mixture of 0.1 g/l of a dye corresponding to formula A, 0.15 g/l of a dye corresponding to formula B and 1.1 g/l of a dye corresponding to formula C, to obtain a silver-grey colour. The dye absorption is 100%. The dye is then fixed under saturated steam conditions at 102° C in a steaming tube. The residence time is 12 minutes. The fixed silver-grey dyed tow is then washed, provided with an antistatic preparation and dried under tension at 104° C in a drying unit comprising 14 perforated drums. It is then crimped and deposited in the form of an endless tow. The final individual denier of the silver-grey dyed tow amounts to 3.2 dtex. Fibre cross-section: thoroughly dyed dumbells. Milliequivalents of acid groups per kg of polymer = 80; fastnesses: as in Example 1. The silver-grey tow is identical in colour and depth of colour with the dyed tow of Example 1.

Dry-spun polyacrylonitrile tows with the chemical composition: 91.1% of acrylonitrile, 5.5% of methyl acrylate and 3.4% of sodium methallyl sulphonate, into which carbon black pigments have been spun in quantities of 0.01, 0.05, 0.1, 0.3 and 2.0% by weight, based on the solids content of the polymer, and which have been dyed various shades from aqueous solutions, are compared in the following Table with tows of the same chemical composition which have been dyed equally deeply, but without any carbon black. The percentage saving of dye per individual dye and the average total saving of dye are shown in columns 4 and 5 of this Table. The formulae for the dyes used are given in the preceding Examples.

| | | Dye concentration (g/l) | | | |
|---|---|---|---|---|---|
| | | Fibre with 0.01% by weight of carbon | Fibre without carbon | Percentage savings of dye | |
| Colour | Dye | black | black | Indificual | Total |
| beige | A | 1.1 | 1.2 | 8 | |
| Barbary | B | 0.48 | 0.7 | 31 | 32 |
| | C | 0.4 | 1.0 | 60 | |
| | | Fibre with 0.05% by weight of carbon black | Fibre without carbon black | | |
| beige | A | 2.6 | 3.0 | 13 | |
| brown | B | 2.0 | 2.7 | 26 | 41 |
| | C | 0.46 | 2.7 | 83 | |
| gold- | A | 5.0 | 5.0 | — | |
| brown | B | 1.8 | 2.5 | 28 | 37 |
| | C | 0.4 | 2.5 | 84 | |
| fox- | A | 5.0 | 5.0 | — | |
| brown | B | 1.5 | 2.4 | 37 | 41 |
| | C | 0.4 | 2.6 | 85 | |
| old- | B | 1.3 | 3.0 | 57 | |
| gold | C | 4.0 | 8.4 | 52 | 43 |
| | D | 12.0 | 15.0 | 20 | |
| | | Fibre with 0.1% by weight of carbon black | Fibre without carbon black | | |
| mid- | A | 0.8 | 1.8 | 55 | |
| grey | B | 2.0 | 3.0 | 33 | 37 |
| | C | 10.0 | 13.0 | 23 | |
| stone- | A | 1.8 | 4.0 | 55 | |
| grey | B | 1.6 | 4.0 | 60 | 57 |
| | C | 5.2 | 12.0 | 57 | |
| dove- | A | 2.8 | 4.4 | 36 | |
| grey | B | 4.0 | 5.5 | 27 | 29 |
| | E | 9.0 | 12.0 | 25 | |
| copper- | D | 14.0 | 14.0 | — | |
| brown | E | 0.5 | 1.8 | 72 | 24 |
| | G | 13.5 | 13.5 | — | |

-continued

| | | Fibre with 0.3% by weight of carbon black | Fibre without carbon black | | |
|---|---|---|---|---|---|
| mid-brown | A | 2.8 | 5.5 | 49 | |
| | C | 0.8 | 12.0 | 93 | 67 |
| | G | 2.0 | 5.0 | 60 | |
| dark brown | D | 8.0 | 10.0 | 20 | |
| | E | 1.75 | 10.0 | 82 | 46 |
| | G | 4.5 | 7.0 | 36 | |
| bear brown | D | 13.0 | 13.0 | — | |
| | E | 5.0 | 12.0 | 58 | 28 |
| | G | 7.5 | 10.0 | 25 | |
| bottle-green | D | 7.2 | 18.0 | 60 | |
| | E | 10.8 | 31.5 | 66 | 68 |
| | G | 0.42 | 2.0 | 79 | |
| | | Fibre with 2.0% by weight of carbon black | Fibre without carbon black | | |
| black | D | 1.0 | 11.0 | 91 | |
| | G | 2.5 | 11.0 | 77 | 82 |
| | F | 2.0 | 9.0 | 78 | |

We claim:

1. A process for the production of a dyed filament or fibre of an acrylonitrile polymer, wherein 0.001–3% by weight of carbon black pigment is added to the polymers before the actual spinning process and the filament or fibre containing said carbon black pigment is dyed after spinning.

2. The process of claim 1, wherein said carbon black pigment is added to the spinning solution.

* * * * *